United States Patent [19]

Dean

[11] 4,446,583

[45] May 8, 1984

[54] ADJUSTABLE TOOL FOR TUB OVERFLOW

[76] Inventor: David F. Dean, 75 Berkeley St., Rochester, N.Y. 14607

[21] Appl. No.: 392,746

[22] Filed: Jun. 28, 1982

[51] Int. Cl.[3] ..... E03C 1/24

[52] U.S. Cl. ..... 4/206; 4/661

[58] Field of Search ..... 4/204, 206, 661; 81/1 R, 3 R

[56] References Cited

U.S. PATENT DOCUMENTS

| | | | |
|---|---|---|---|
| 328,354 | 10/1885 | Stears | 4/204 |
| 1,191,088 | 7/1916 | Mercer | 4/206 UX |
| 1,195,827 | 8/1916 | Lucke | 4/204 X |
| 1,281,222 | 10/1918 | Stepanchak | 4/206 |
| 2,951,504 | 9/1960 | McBroom | 4/206 UX |
| 3,228,039 | 1/1966 | Freeman | 4/206 |
| 3,281,865 | 11/1966 | Young | 4/206 |
| 3,570,020 | 3/1971 | Kato | 4/206 |

*Primary Examiner*—Henry K. Artis

*Attorney, Agent, or Firm*—Shlesinger, Fitzsimmons & Shelsinger

[57] ABSTRACT

A pair of rigid discs are riveted coaxially together at their centers to permit relative rotation therebetween. One disc has therethrough a pair of spaced, elongate slots, and the other a plurality of pairs of circular openings which are arranged about the axis of the discs in such a manner that only one pair thereof at a time can register with the two slots in said one disc. A resilient backing layer of rubber or the like is secured to the outer face of one of the discs and has therethrough a plurality of slots or openings which are similar to, and in registry with, the slots or openings in the disc to which it is secured. In use the overflow strainer of a tub is removed to expose the overflow opening, and the discs are rotatably adjusted until one of the pairs of circular openings registers through the pair of slots with the strainer mounting lugs. The same screws which were used to secure the overflow strainer to the tub are then used to secure the seal to the tub with the resilient backing material closing off the overflow opening. Each pair of circular openings is adapted to a register with a different type of strainer mount, so that the seal can be used on different types of tubs. Also, an additional circular opening is formed through each disc adjacent its center line for use in securing the seal to a tub of the type which has only a single, centrally disposed mounting lug for the overflow strainer.

10 Claims, 4 Drawing Figures

ADJUSTABLE TOOL FOR TUB OVERFLOW

BACKGROUND OF THE INVENTION

This invention relates to a novel tool for sealing the water overflow outlet normally found in bathtubs and the like; and more particularly it relates to an adjustable tool for preventing flow of both water and air through a conventional tub overflow.

One of the major problems encountered by plumbers, when attempting to unplug the drain of a bathtub or the like, is to find some means for sealing off the overflow opening or outlet so as to prevent the escape of air through the outlet during a plunging operation on the drain. One known way of sealing the overflow is to employ a wet rag, which the operator attempts to hold with one hand over the strainer on the outlet overflow while attempting to plunger the tub drain with his or her other hand. In most conventional tubs the overflow opening is located adjacent the upper edge of the tub, almost directly above the tub drain, so that it makes it rather difficult for the operator to hold a wet rag over the outlet with one hand, while manipulating a plumber's aid with his or her other hand.

This problem is made even more difficult in the case of modern-day bathtubs, which often have a pivotal or rotatable valve operating member projecting from the center of the strainer or grate that covers the overflow opening. The presence of such member makes it almost impossible to seal the overflow airtight with a wet rag.

Heretofore efforts have been made to provide some means for sealing tub or sink overflows, but for purposes unrelated to the plunging of the drain. For example, U.S. Pat. No. 328,354 discloses the use of a rotatable, semi-circular valve or plate, which is mounted to rotate on the face of a perforated overflow strainer in such a manner that when the valve plate is rotated approximately 180° in one direction it will tend to close the perforations in the strainers, and when rotated in the opposite direction it uncovers the perforations. The purpose of such a valve, however, was merely to prevent the escape of sewer gases out of the drain and into the overflow pipe when the associated basin or tub was not in use. There was absolutely no suggestion or concern with providing for the overflow an airtight seal which is capable of withstanding the violent bursts of air pressure which are developed when a drain pipe is being plungered.

U.S. Pat. No. 1,281,222 also teaches the desirability of employing a rotatable valve plate for selectively closing the ports in the cover plate or strainer for a tub overflow, but again, the patentee appparently was not concerned with providing an airtight seal which could withstand severe applications of air pressure, such as are encountered when a tub drain is being plungered. Moreover, these prior overflow valves were designed for specific installations, and therefore had utility only for the particular overflow drains for which they were designed. Furthermore, with today's modern tubs where the drain valve operating member is mounted for movement on the overflow strainer, the rotable cover valves as taught by these prior art references would be of absolutely no use, and could not be employed for the same purpose.

Accordingly, it is an object of this invention to provide a novel tool which can be used for sealing the overflow opening in any of a great variety of tubs, thereby to prevent any air from being exhausted through the overflow opening during the plunging of the main drain of the tub.

A further object of this invention is to provide a novel plumber's aid, which is relatively simple and inexpensive to manufacture, and which can be readily secured over the overflow of a conventional tub whenever it is desired to seal the overflow for the purpose of plungering the main drain of the tub.

A more specific object of this invention is to provide a novel, adjustable overflow seal, which is adapted to be releasably and sealingly secured over a bathtub overflow in place of the overflow strainer, and by the same screws used for securing the strainer to the tub.

Other objects of the invention will be apparent hereinafter from the specification, and from the recital of the appended claims, particularly when read in conjunction with the accompanying drawing.

SUMMARY OF THE INVENTION

The tool comprises a pair of rigid, disc-shaped plates of equal diameter, which are rotatably connected coaxially to each other by a rivet which extends centrally through the plates and a rubber backing layer, which is secured to the outer surface of one of the plates. In one embodiment, the rubber-backed plate has therethrough a pair of spaced, elongate slots, which are located at diametrally opposite sides of the rivet for registration selectively with one of a plurality of pairs of circular openings that extend through the other, outer plate, and which are designed to register selectively with the two mounting lugs for overflow strainers on different types of bathtubs. In use, the overflow strainer of the tub to be plungered is removed, thus exposing two, stationary, internally threaded lugs which will register with one of the several pairs of circular openings in the outer plate. The outer plate is then rotated, relative to the rubber-backed plate until the correct openings register with the slots in the rubber-backed plate, and with the mounting lugs. The same screws which were used for mounting the strainer on the overflow are now used to secure the seal over the overflow opening, and with the rubber layer sealingly seated around its marginal edge over the overflow opening, so that absolutely no air can pass through the opening when plunging takes place.

An additional circular opening in the outer plate adjacent the rivet is registrable with aligned openings in the other plate and its rubber backing for use when a single, central mounting lug is used for securing a strainer over the tub overflow. And in a second embodiment the slotted plate is the outer plate, and the rubber-backed plate contains the pairs of circular openings.

THE DRAWING

DETAILED DESCRIPTION OF THE PREFERRED EMBODIMENTS

Figure 1:
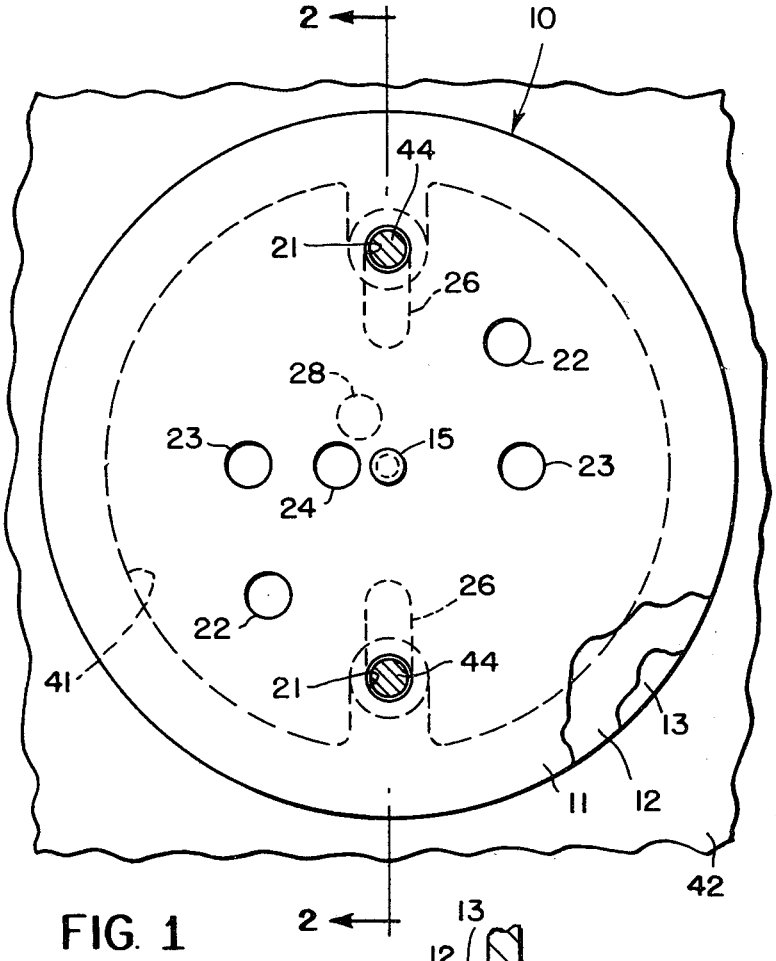
FIG. 1 is a fragmentary elevational view of part of a tub wall having secured over its overflow opening an adjustable seal made according to one embodiment of this invention, the mounting screws for the seal being shown in section, and portions of the seal being cut away.

Referring now to the drawing by numerals of reference, and first to FIGS. 1–3, 10 denotes generally an adjustable seal comprising a pair of rigid, superposed, discs or circular plates 11 and 12, which are equal in diameter, and one of which (disc 12 in the first embodiment) has a resilient backing layer 13 of rubber, or the like, secured to the face thereof remote from disc 11. Discs 11 and 12 are rotatably secured together at their centers by a conventional rivet 15, or the like, which extends coaxially through the discs and the backing layer 13, and which permits disc 11 to be rotated relative to disc 12. As noted above, however, layer 13 is fastened to disc 12 so that it cannot be rotated relative thereto.

Disc 11 has therethrough three pairs of opposed, radially spaced circular openings 21, 22 and 23, which are equal in diameter. The first pair of openings 21 are equispaced radially from the centerline of rivet 15 a first distance $r_1$, while the second pair of openings 22 are equispaced radially from the rivet axis a second distance $r_2$, which is less than the radial distance $r_1$. Finally, the third pair of openings 23 are equispaced radially from the axis of rivet 15 a third radial distance $r_3$ which is less than the distance $r_2$.

In addition to the three pairs of circular openings 21, 22 and 23, disc 11 has therethrough a further, circular opening 24, which is radially spaced from the rivet 15 a distance $r_4$ substantially less than the radii $r_1$, $r_2$ and $r_3$.

Disc 12 has therethrough adjacent diametrally opposite sides of rivet 15 a pair of spaced, elongate slots 26, the centerlines of which lie in a common plane that extends through the axis of rivet 15. Each of the slots 26 registers with a like slot 27 formed through the rubber backing layer 13. Each of the slots 26 and 27 has a width equal to the diameter of each of the openings 21–23 in the disc 11. Moreover, each of the slots 26 and 27 has an overall length sufficient to enable each pair of openings 21, 22 and 23 in disc 11 to register selectively and one pair at a time with the slots 26, and hence the slots 27, upon proper rotation of disc 11 relative to disc 12. In other words, assuming that the slots 26, 27 are in the position as shown in FIG. 1, the pair of openings 21 in disc 11 will register with the outer ends of slots 26, 27 when disc 11 is in the position as shown in FIG. 1. However, when disc 11 is rotated relative to disc 12, for example approximately 45° counterclockwise in FIG. 1, then the second pair of openings 22 will be rotated into registry with approximately the midportions of the two slots 26, and consequently the midportions of the slots 27 in the backing layer. On the other hand if disc 11 is rotated 90° relative to disc 12 from its position as shown in FIG. 1, then the pair of openings 23 will register with the inner ends of slots 26, and hence the corresponding inner ends of the slots 27 in the backing layer. Moreover in each such adjusted position of disc 11 it will be apparent that only one pair of openings 21, 22 or 23 register with the slots 26, 27 at any one time, so that for example when the openings 21 register with the slots 26, 27, the remaining openings 22, 23 and 24 in disc 11 do not register with any other openings in plates 12 and 13, and consequently are closed by disc 12 as noted hereinafter.

Figure 3:
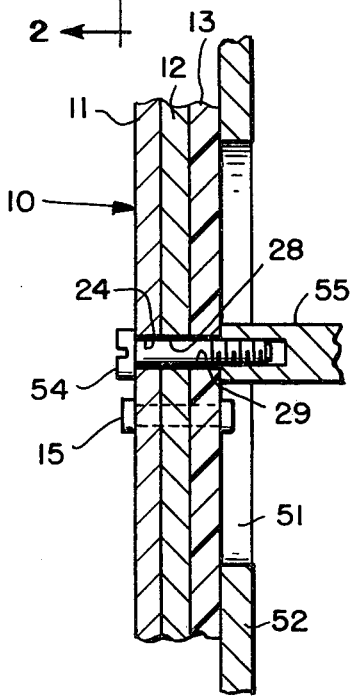
FIG. 3 is a fragmentary sectional view generally similar to FIG. 2, but on a smaller scale, and illustrating this seal as it appears when it is mounted in a sealing position over a different type of tub overflow.

In addition to the slots 26 and 27 disc 12 and its backing layer 13 also have therethrough a pair of registering, circular openings 28 and 29, respectively (FIGS. 1 and 3), which, in still another angular position of disc 11 relative to disc 12, will register with the opening 24 in disc 11 (FIG. 3). When this occurs the remaining pairs of openings 21–23 in disc 11 will not, at that particular time, register with any openings in discs 12 and 13, and will therefore be closed by disc 12.

Figure 2:
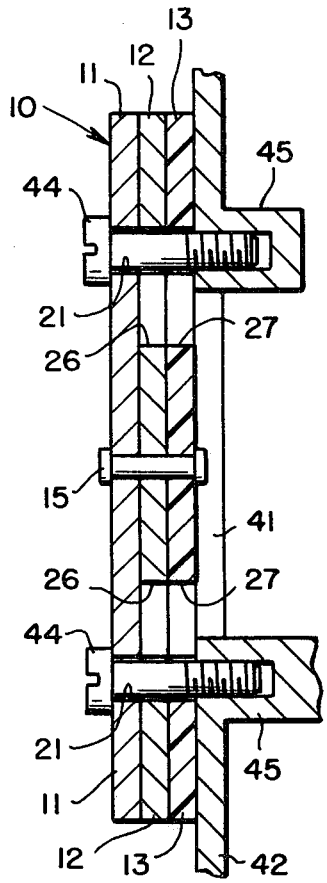
FIG. 2 is a fragmentary sectional view taken along the line 2—2 in FIG. 1 looking in the direction of the arrows.

In use, the seal 10 is adapted to replace the strainer or perforated overflow plate which is normally secured by one or more screws over the opening in the wall of a tub or the like. In FIGS. 1 and 2, for example, the seal 10 is shown as it appears when it is secured over the overflow opening 41 in the wall 42 of a tub by means of a pair of screws 44, the shanks of which extend through openings 21 in disc 11, the registering slots 26 and 27 in disc 12 and backing 13, and into threaded recesses formed in a pair of stationary lugs 45, which project from the tub wall 42 adjacent dismetrally opposite sides of its opening 41.

In this type of tub (see for example U.S. Pat. No. 2,178,493) the opening 41 normally is covered by an overflow strainer plate (not illustrated) upon which is movably mounted a manually operable member for manipulating the valve, which controls the associated tub drain or outlet. Moreover, with tubs of this type, the distance between the lugs 45 may differ slightly from tub to tub, depending upon the manufacturer. It is for this reason that three pairs of mounting openings 21, 22 and 23 are used in plate 11 for selective registry with the slots 26 and 27 in plate 12 and backing 13. In the case of the tub shown in FIGS. 1 and 2, for example, the first set of openings 21 register exactly with the openings in the mounting lugs 45 on the tub wall, so that in order to mount the seal 10 one need only to remove the screws 44 and the associated overflow strainer (not illustrated), and then place the resilient layer 13 against the outside surface of the wall 42 over opening 41. The disc 11 is then rotated relative to disc 12 until the pair of openings 21 register through the slots 26, 27 with the threaded recesses in the lugs 45. The same screws 44, which are normally used to mount the strainer plate over the overflow opening 41, can then be used securely to fastened the seal 10 in its operative position (FIGS. 1 and 2) over the opening 41. In this position the screws 44 draw the resilient disc 13 snugly and sealingly against the outer surface of the tub 42 around opening 41, and urge plate 11 sealingly against plate 12, so that the latter completely blocks the remaining openings 22, 23 and 24 in disc 11, thereby preventing any air from passing through the seal 10 into the opening 41, or vice versa. This completely seals the opening 41 so that the drain in the associated pipe can now be satisfactorily plungered. After the plunging operating the seal 10 can be removed and the overflow strainer (not illustrated) can be replaced over the opening 41.

The two remaining pairs of openings 22 and 23 in disc 11 are designed slectively to register with mounting lugs, such as lugs 45, on other conventional tubs of the type in which the lugs are positioned closer to the rivets 15.

In addition to tubs of the type which use mechanically operated valves for opening and closing the drain, there are still a number of so-called old fashioned tubs, which use simple plugs for closing the drain, and which therefore do not require overflow strainers which have operating members mounted thereon. The overflow opening 51 (FIG. 3) in the wall 52 of these old fashioned tubs is normally closed by a plate strainer (not illustrated) having a central opening by means of which it is secured by a screw 54 to a stationary lug 55 disposed centrally of the overflow opening 51. To seal this type of opening, the disc 11 is rotated until its opening 24 registers with the openings 28 and 29 in disc 12 and backing 13. The overflow strainer is then removed from the mounting lug 55, and the seal 10 is positioned so that its registering openings 24, 28 and 29 are aligned with the threaded bore in the lug 55, after which the screw 54 is used to secure the seal 10 over the opening 51 as shown in FIG. 3. In this position it will be noted that the rivet 15 is slightly off center relative to the opening 51, but the outside diameter of the seal 10 is large enough so that it will provide ample surface area for engagement with the tub wall 52 completely around the opening 51. In this way the opening 51 can be sealed to allow the plunging of the associated drain in a manner that will be apparent from the above description. Thereafter the seal 10 can be removed and the strainer plate can be reattached to the lug 55 to complete the operation.

Figure 4:
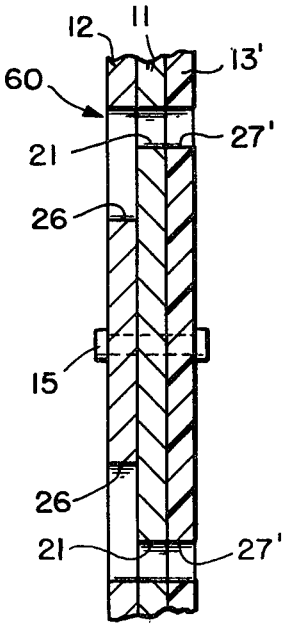
FIG. 4 is a fragmentary sectional view similar to FIG. 3 but showing a modified form of the seal.

In the modified seal 60 shown in FIG. 4, wherein like numerals are employed to denote elements similar to those used in the first embodiment, the slotted disc 12 is rotatably mounted over the face of disc 11 by the screw 15; and the resilient backing layer 13' is secured to the outer face of disc 11, rather than the disc 12. Moreover, the layer 13' has therethrough a plurality of circular openings which are equal in number to and in registry with, the openings 21–24 in disc 11. Two such circular openings in layer 13' are denoted at 27' in FIG. 4, and register with the openings 21 in disc 11.

The modified seal 60 is adapted to be employed in a manner similar to seal 10, the only difference being that slots 26 and opening 28 are now visible, while the circular openings 21–24 in disc 11 are visible only when aligned with slots 26 or opening 28.

From the foregoing it will be apparent that the present invention provides a relatively simple and inexpensive tool for sealing the overflow openings in almost any type of tub currently available on the market, or in use. The discs 11 and 12 are rotatably adjustable one relative to the other to enable the seal to be subsituted for overflow strainers which are mounted on the tub either by a pair of screws, such as screws 44, or by a single screw 54, such as shown in FIG. 3. In either case the resilient backing plate 13 is secured sealingly around the overflow opening, and the plates 11 and 12 are drawn snugly against each other to prevent any seepage of air through the seal during a plunging operation.

Although not shown in the drawing, it will be apparent that the openings in the outer plate 11 in the first embodiment (FIGS. 1–3), or plate 12 in the second embodiment (FIG. 4), may be countersunk for appearance sake, and also to improve the seal between the screws 44, 54 and the associated openings. Moreover, while this invention has been illustrated and descirbed in detail in connection with only certain embodiments thereof, it will be apparent that it is capable of still further modification, and that this application is intended to cover any such modifications as may fall within the scope of one skilled in the art, or the appended claims.

Having thus described my invention, what I claim is:

1. An adjustable tool disposed to be releasably secured over and to seal any one of a variety of different types of tub overflow openings during the plunging of an associated tub drain, comprising a first rigid member having therethrough a pair of spaced, elongate openings registrable selectively with any one of a plurality of pairs of differently spaced mounting lugs on different tub overflows, a second rigid member having therethrough a plurality of angularly spaced pairs of circular openings, each of said pairs of circular openings also being registrable selectively with one of said pairs of spaced mounting lugs, and means connecting said members together for adjustment relative to each other into any one of a first plurality of different operating positions in each of which one only of said pairs of circular openings in said second member registers with said elongate openings in said first member, one of said members having a layer of resilient material secured to the side thereof opposite the other member, and having therethrough a plurality of openings similar to, and registering with, the openings in said one member.

2. An adjustable tool as defined in claim 1, wherein a further circular opening extends through each of said members adjacent the center thereof, and said further openings register with each other and a like opening in said layer of resilient material only when said members are in an operating position different from any of said first plurality of positions.

3. An adjustable tool as defined in claim 1, wherein said layer of resilient material is secured to said first member at the side thereof opposite said second member.

4. An adjustable tool as defined in claim 1, wherein said layer of resilient material is secured to said second member at the side thereof opposite said first member.

5. An adjustable tool as defined in claim 1, wherein said members are circular discs of substantially equal diameter, and said discs are joined by said connecting means for rotation relative to each other about a common axis that extends coaxially of said discs.

6. An adjustable tool as defined in claim 5, wherein the two circular openings of each pair thereof in said second member are equispaced radially from diametrally opposite sides of said common axis, and the radial distances of one of said pairs of circular openings from said common axis are different from the radial distances of the other pairs of circular openings.

7. An adjustable tool as defined in claim 6, wherein said elongate openings in said first member are equispaced from opposite sides of said axis and have longitudinal centerlines which lie in a plane containing said axis.

8. An adjustable tool as defined in claim 7, wherein said pairs of circular openings are angularly spaced from each other about said axis, whereby only one pair thereof at a time can register with said elongate openings in said first member.

9. An adjustable stool as defined in claim 8, wherein said further circular openings in said members are equispaced radially from said axis a distance less than each of said pairs of circular openings.

10. An adjustable tool as defined in claim 1, wherein said first and second members are similarly shaped and said connecting means comprises a rivet textending through the centers of said members to allow relative rotation therebetween.

* * * * *